US010655436B2

(12) United States Patent
Liu et al.

(10) Patent No.: US 10,655,436 B2
(45) Date of Patent: May 19, 2020

(54) DEVICE AND METHOD FOR SOLID-STATE FLUIDIZATION MINING OF SEABED SHALLOW LAYER NON-DIAGENETIC NATURAL GAS HYDRATES

(71) Applicant: SOUTHWEST PETROLEUM UNIVERSITY, Chengdu (CN)

(72) Inventors: Qingyou Liu, Chengdu (CN); Guorong Wang, Chengdu (CN); Shouwei Zhou, Chengdu (CN); Leizhen Wang, Chengdu (CN); Rong Huang, Chengdu (CN); Qingping Li, Chengdu (CN); Qiang Fu, Chengdu (CN)

(73) Assignee: SOUTHWEST PETROLEUM UNIVERSITY, Chengdu (CN)

( * ) Notice: Subject to any disclaimer, the term of this patent is extended or adjusted under 35 U.S.C. 154(b) by 231 days.

(21) Appl. No.: 16/063,703

(22) PCT Filed: Apr. 24, 2017

(86) PCT No.: PCT/CN2017/081581
§ 371 (c)(1),
(2) Date: Jun. 19, 2018

(87) PCT Pub. No.: WO2018/191991
PCT Pub. Date: Oct. 25, 2018

(65) Prior Publication Data

US 2020/0072028 A1 Mar. 5, 2020

(30) Foreign Application Priority Data

Apr. 17, 2017 (CN) ..... 2017 1 0249143

(51) Int. Cl.
*E21B 43/01* (2006.01)
*E21B 43/24* (2006.01)
(Continued)

(52) U.S. Cl.
CPC ..... *E21B 43/01* (2013.01); *E21B 43/24* (2013.01); *E21B 43/36* (2013.01); *E21B 43/40* (2013.01);
(Continued)

(58) Field of Classification Search
CPC ..... E21B 43/01; E21B 43/24; E21B 43/36; E21B 43/40; E21B 49/00; E21B 2043/0115
(Continued)

(56) References Cited

U.S. PATENT DOCUMENTS

2003/0106714 A1* 6/2003 Smith ..... B08B 9/04 175/6
2005/0035224 A1* 2/2005 Dodd ..... B05B 1/1672 239/548
2007/0145810 A1 6/2007 Wendland

FOREIGN PATENT DOCUMENTS

CN 102392646 A * 3/2012 ..... E21B 50/00
CN 102392646 A 3/2012
(Continued)

*Primary Examiner* — Anna M Momper
*Assistant Examiner* — Patrick F Lambe
(74) *Attorney, Agent, or Firm* — Bayramoglu Law Offices LLC

(57) ABSTRACT

The present invention discloses a device for solid-state fluidization mining of seabed shallow layer non-diagenetic natural gas hydrates. The device comprises a hydraulic jet nozzle set, a coiled tubing, a hydrate collecting ship arranged on the sea surface, a transfer station arranged in sea water and a riser arranged in a seabed surface layer. A guide seat is arranged in the riser. The hydraulic jet nozzle set is arranged in the guide seat. A delivery pipe connected with the transfer station sleeves a nozzle body. An opening is formed in a position where the delivery pipe is in contact with the nozzle body. The transfer station is connected with the hydrate collecting ship. The present invention further
(Continued)

discloses a method for collecting seabed shallow layer non-diagenetic hydrates.

14 Claims, 2 Drawing Sheets

(51) Int. Cl.
*E21B 43/36* (2006.01)
*E21B 43/40* (2006.01)
*E21B 49/00* (2006.01)

(52) U.S. Cl.
CPC ..... *E21B 49/00* (2013.01); *E21B 2043/0115* (2013.01)

(58) Field of Classification Search
USPC ..... 166/350
See application file for complete search history.

(56) References Cited

FOREIGN PATENT DOCUMENTS

| | | | |
|---|---|---|---|
| CN | 103628844 | A | 3/2014 |
| CN | 105064959 | A | 11/2015 |
| CN | 105587303 | A | 5/2016 |
| WO | 0047832 | A1 | 8/2000 |

* cited by examiner

DEVICE AND METHOD FOR SOLID-STATE FLUIDIZATION MINING OF SEABED SHALLOW LAYER NON-DIAGENETIC NATURAL GAS HYDRATES

CROSS REFERENCE TO RELATED APPLICATIONS

This application is the national phase entry of International Application No. PCT/CN2017/081581, filed on Apr. 24, 2017, which is based upon and claims priority to Chinese Patent Application No. 201710249143.X filed on Apr. 17, 2017, the entire contents of which are incorporated herein by reference.

TECHNICAL FIELD

The present invention relates to the technical field of seabed natural gas hydrate mining, and in particular to a device and method for solid-state fluidization mining of seabed shallow layer non-diagenetic natural gas hydrates.

BACKGROUND

Natural gas hydrates are also called "combustible ice". The "cage compound" formed by methane-based hydrocarbon gas and water under certain temperature and pressure conditions is of a white crystalline structure, and has a carbon content equivalent to twice total reserves of worldwide known energy sources, such as coal, oil and natural gas. Therefore, natural gas hydrates, especially marine natural gas hydrates, are generally considered to be a novel clean energy source that will replace coal, oil and natural gas in the 21st century, and are also a new energy source with large reserves that has not been developed yet at present.

According to whether or not a skeleton structure of an ore bed in which hydrates have been decomposed and gasified can be maintained without loosening and falling (i.e., load-bearing), seabed natural gas hydrate ore beds can be divided into diagenetic ore beds and non-diagenetic ore beds. At present, the mainstream opinion is that: diagenetic hydrates are more likely to be mined in the technical level than non-diagenetic hydrates, but the vast majority of seabed hydrates are non-diagenetic.

At present, main methods considered at home and abroad for hydrate mining include a heat injection method, a pressure reduction method, a carbon dioxide replacement method, a chemical reagent injection method, and the like. These mining methods ask for the requirements that an upper layer of hydrates has a good capping layer with a large thickness and a solid structure and the skeleton of the ore bed in which hydrates have been mined and decomposed can be still maintained without loosening, i.e., the ore bed is a diagenetic hydrate ore bed itself, otherwise, after gases are decomposed from the hydrates, the skeleton structure of the ore bed will disappear, and the large amount of gases produced by decomposition will change the formation pressure. In addition, the above-mentioned mining methods cannot effectively control the decomposition rate of hydrates and the spatial decomposition range of the ore bed, which may cause geological and environmental disasters, because the formation of hydrate decomposition chain reactions will cause major disasters. Another risk is that, after the hydrates are decomposed and gasified, if the capping layer is not good, gases may diffuse through the capping layer. To sum up, the above-mentioned mining methods have still not been able to effectively solve the above problems and are no longer expected to be in commercial mining.

In view of natural gas hydrates on the surface of the deep sea, some scholars have proposed a "solid-state fluidization" mining method. In this method, in the case of not actively changing the temperature and pressure of a seabed hydrate ore bed, that is, avoiding the occurrence of decomposition of hydrates and the resulting environmental and geological disasters, natural gas hydrates are directly broken into solid particles, and the mixture of the natural gas hydrate particles and sea water is pumped to the sea surface through an airtight pipeline, and then separated, decomposed and gasified.

Solid-state fluidization provides a new idea for the mining of shallow layer non-diagenetic natural gas hydrates of the deep sea. At present, a mining device for seabed shallow layer hydrates is a self-propelled mining vehicle, but it is not suitable for seabed shallow layer hydrates having certain burial depth and is low in economical efficiency.

SUMMARY

An objective of the present invention is to overcome the defects of the prior art and provide a device for solid-state fluidization mining of seabed shallow layer non-diagenetic natural gas hydrates, which has a compact structure and high mining efficiency and has the beneficial effects of saving energy sources, avoiding pollutions to the sea and decreasing the mining cost of natural gas.

The objective of the present invention is implemented by means of the following technical solution: a device for solid-state fluidization mining of seabed shallow layer non-diagenetic natural gas hydrates comprises a hydraulic jet nozzle set, a coiled tubing, a hydrate collecting ship arranged on the sea surface, a transfer station arranged in sea water and a riser arranged in a seabed surface layer, wherein a guide seat is arranged in the riser; the hydraulic jet nozzle set is arranged in the guide seat; the hydraulic jet nozzle set comprises a nozzle body, a sleeve I, a sleeve II and a spray head, wherein the right end of the nozzle body is connected with the left end of the sleeve I; the nozzle body is internally provided with a flow passage which is communicated with the sleeve I; a cylindrical surface of the nozzle body is uniformly distributed with a plurality of oblique jet holes A communicated with the flow passage in a circumferential direction of the cylindrical surface; the oblique jet holes A tilt to the left and are arranged eccentrically from the nozzle body; the sleeve II consists of a big shaft and a small shaft which are connected in sequence; the big shaft is arranged in the sleeve I and has a gap therebetween; an asbestos filter net is propped between the big shaft and the nozzle body; the small shaft penetrates through the sleeve I along an axis of the sleeve I and is connected with the spray head; the left end of the spray head is provided with a cavity which is communicated with the sleeve II, and the right end of the spray head is provided with an axial jet hole communicated with the cavity; a cylindrical surface of the spray head is uniformly distributed with a plurality of oblique jet holes B communicated with the cavity in a circumferential direction of the cylindrical surface; the oblique jet holes B tile to the right and are arranged eccentrically from the spray head; the guide seat is internally provided with a straight channel and an L-shaped channel from top to bottom; the straight channel is connected with the transfer station via a pipeline; a delivery pipe is arranged in the L-shaped channel; one end of the coiled tubing is connected to the hydrate collecting ship, and the other end of the coiled tubing penetrates through the pipeline from top to bottom and is communicated with the flow passage of the nozzle body; one end of the delivery pipe sleeves the coiled tubing, and the other end of the delivery pipe sleeves the nozzle body; an opening is formed in each of two ends of the delivery pipe; the transfer station is connected with the hydraulic connecting ship.

The right end of the nozzle body is provided with external threads, the left end surface of the sleeve I is provided with a threaded hole, and the threaded hole of the sleeve I is connected with the external threads of the nozzle body.

The right end of the small shaft is provided with external threads, and the cavity is internally provided with a threaded hole.

The spray head is fixedly connected to the sleeve II via the threaded hole and the external threads of the small shaft.

The left end surface and the right end surface of the big shaft are respectively provided with a flow channel.

The flow channels are uniformly distributed in a circumferential direction of the big shaft.

The transfer station is a deliver pump.

A method for solid-state fluidization mining of seabed shallow layer non-diagenetic natural gas hydrates by using the device described above comprises the following steps:

S1, lowering of the riser: drilling from the seabed surface layer to a hydrate ore bed using a jet drilling method, and lowering the riser into a drilled wellbore, wherein the riser connects the seabed surface layer with the hydrate ore bed to form a drilling fluid circulating channel while isolating seawater, thereby realizing the lowering of the riser;

S2, lowering of the guide seat: controlling a drilling direction by using the guide seat, and adjusting a wellbore trajectory to a horizontal mode;

S3, lowering and mounting of the hydraulic jet nozzle set: lowering the hydraulic jet nozzle set to a horizontal channel of the L-shaped channel of the guide seat first, such that the hydraulic jet nozzle set is positioned in the hydrate ore bed; connecting the flow passage of the nozzle body and the hydrate collecting ship by using the coiled tubing, and then sleeving the nozzle body with one end of the delivery pipe; and finally connecting a straight channel of the guide seat and the transfer station by using the pipeline, thereby realizing the lowering and mounting of the hydraulic jet nozzle set;

S4, crushing of hydrates: introducing high-pressure seawater to the coiled tubing by using the hydrate collecting ship, wherein a part of high-pressure seawater sequentially flows through the flow passage, the sleeve I, the sleeve II and the cavity and is finally jetted from the axial jet hole and the oblique jet holes B, hydrates in the horizontal direction are crushed by high-pressure jet water jetted from the axial jet hole to form solid particle hydrates while an advancing channel is opened up; however, the high-pressure seawater jetted from the oblique jet holes B has an opposite acting force, thereby forming a torque and further driving the spray head and the sleeve II to rotate circumferentially; the high-pressure jet water sweeps over a circle or a spiral line to crush the hydrates in the circumferential direction to form solid particle hydrates, thereby forming a cylindrical crushed ore cavity in the hydrate ore bed; the other part of high-pressure seawater is jetted from the oblique jet holes A to provide an advancing power for the whole hydraulic jet nozzle set and the coiled tubing, and meanwhile, water current jetted backwards will contribute to a backward movement of the front crushed solid particle hydrates along with the water current, which is beneficial to the collection of particles; and S5, collection of the crushed solid particle hydrates: driving, by the water current jetted from the oblique jet holes A, the solid particle hydrates to move backwards, wherein the solid particle hydrates enter the delivery pipe from an opening in the left side of the delivery pipe, move along the delivery pipe, flow out from an opening in the right side of the delivery pipe, pass through the straight channel and the pipeline in sequence and finally enter into the transfer station, and are ultimately delivered to the hydrate collecting ship from the transfer station and are collected, thereby realizing massive and high-efficiently collection of the crushed solid particle hydrates.

The present invention has the following advantages: (1) the structure is compact, energy sources are saved, the mining cost of natural gas is reduced, and the collection efficiency is high. (2) In the case of not changing the temperature and pressure of the seabed hydrate ore bed, naural gas hydrates are directly crushed into solid particles, such that the decomposition of hydrates and the resulting environmental and geological disasters are avoided.

Figure 1:
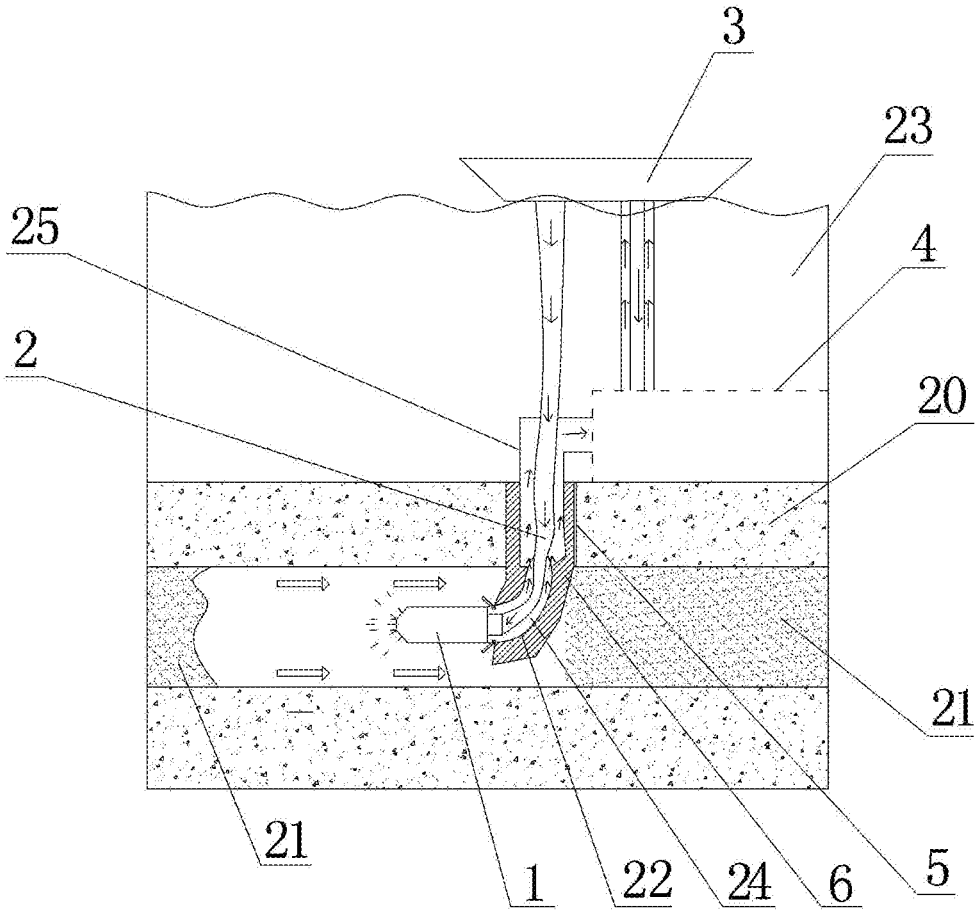
FIG. 1 is a schematic structural diagram of the present invention.

In drawings, sign references represent the following components: 1—hydraulic jet nozzle set; 2—coiled tubing; 3—hydrate collecting ship; 4—transfer station; 5—riser; 6—guide seat; 7—nozzle body; 8—sleeve I; 9—sleeve II; 10—spray head; 11—flow passage; 12—oblique jet hole A; 13—big shaft; 14—small shaft; 15—asbestos filter net; 16—cavity; 17—axial jet hole; 18—oblique jet hole B; 19—flow channel; 20—seabed surface layer; 21—hydrate ore bed; 22—delivery pipe; 23—seawater; 24—L-shaped channel; 25—pipeline.

DETAILED DESCRIPTION

The present invention will be further described below with reference to the accompanying drawings. The scope of protection of the present invention is not limited to the followings:

As shown in FIGS. 1-4, a device for solid-state fluidization mining of seabed shallow layer non-diagenetic natural gas hydrates comprises a hydraulic jet nozzle set 1, a coiled tubing 2, a hydrate collecting ship 3 arranged on the sea surface, a transfer station 4 arranged in sea water and a riser 5 arranged in a seabed surface layer 20. A guide seat 6 is arranged in the riser 5. The hydraulic jet nozzle set 1 is arranged in the guide seat 6. The guide seat 6 is capable of accurately controlling the hydraulic jet nozzle set 1 to identify and enter a hydrate ore bed 21 and ensuring that a drill assembly forms horizontal drilling. The hydraulic jet nozzle set 1 comprises a nozzle body 7, a sleeve I 8, a sleeve II 9 and a spray head 10, wherein the right end of the nozzle body 7 is connected with the left end of the sleeve I 8. The nozzle body 7 is internally provided with a flow passage 11 which is communicated with the sleeve I 8. A cylindrical surface of the nozzle body 7 is uniformly distributed with a plurality of oblique jet holes A 12 communicated with the flow passage 11 in a circumferential direction of the cylindrical surface. The oblique jet holes A 12 tilt to the left and are arranged eccentrically from the nozzle body 7. The sleeve II 9 consists of a big shaft 13 and a small shaft 14 which are connected in sequence. The big shaft 13 is arranged in the sleeve I 8 and has a gap therebetween. An asbestos filter net 15 is propped between the big shaft 13 and the nozzle body 7 to filter large-particle impurities in high-pressure seawater.

As shown in FIGS. 1-4, the small shaft 14 penetrates through the sleeve I 8 along an axis of the sleeve I 8 and is connected with the spray head 10. The left end of the spray head 10 is provided with a cavity 16 which is communicated with the sleeve II 9, and the right end of the spray head 10 is provided with an axial jet hole 17 communicated with the cavity. A cylindrical surface of the spray head 10 is uniformly distributed with a plurality of oblique jet holes B 18 communicated with the cavity 16 in a circumferential direction of the cylindrical surface. The oblique jet holes B 18 tile to the right and are arranged eccentrically from the spray head 10. The guide seat 6 is internally provided with a straight channel and an L-shaped channel 24 from top to bottom. The straight channel is connected with the transfer station 4 via a pipeline 25. A delivery pipe 22 is arranged in the L-shaped channel 24. One end of the coiled tubing 2 is connected to the hydrate collecting ship 3, and the other end of the coiled tubing 2 penetrates through the pipeline 25 from top to bottom and is communicated with the flow passage 11 of the nozzle body 7. One end of the delivery pipe 22 sleeves the coiled tubing 2, and the other end of the delivery pipe 22 sleeves the nozzle body 7. An opening is formed in each of two ends of the delivery pipe 22. The transfer station 4 is connected with the hydraulic connecting ship 3.

The right end of the nozzle body 7 is provided with external threads, the left end surface of the sleeve I 8 is provided with a threaded hole, and the threaded hole of the sleeve I 8 is connected with the external threads of the nozzle body 7 to form a connector. The right end of the small shaft 14 is provided with external threads, and the cavity 16 is internally provided with a threaded hole. The spray head 10 is fixedly connected to the sleeve II 9 via the threaded hole and the external threads of the small shaft 14 to form another connector.

The left end surface and the right end surface of the big shaft 13 are respectively provided with a flow channel 19 and the flow channels 19 are uniformly distributed in a circumferential direction of the big shaft 13. After fluid is injected to the coiled tubing 2, a small part of the fluid passes through the asbestos filter net 15 to the flow channel 19 on the left end surface of the big shaft 13. When the sleeve 119 is rotated to a certain angle, the flow channel 19 on the right end surface of the big shaft 13 and the flow channel 19 on the left end surface of the big shaft 13 are communicated via the gap, such that a water film is respectively formed on the left end surface and the right end surface of the big shaft 13 to take the effects of lubricating, reducing the friction and prolonging the service life.

Figure 2:
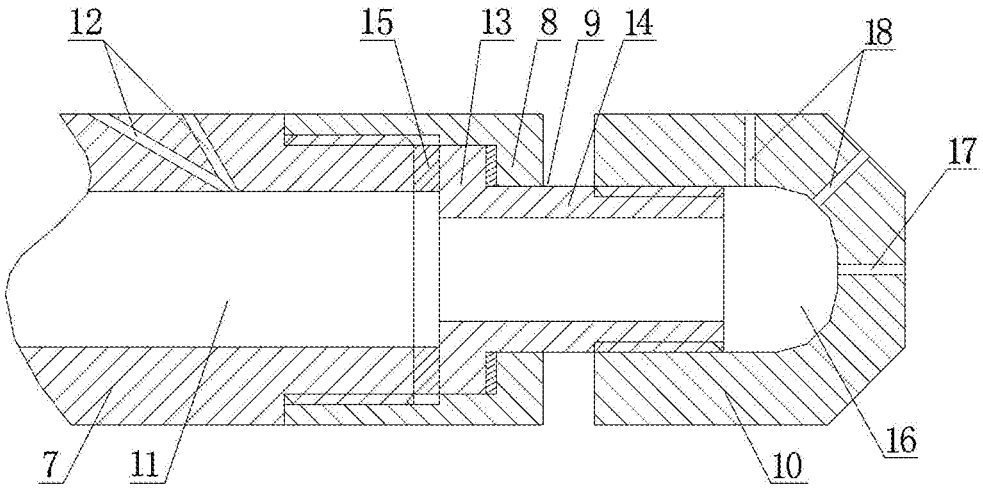
FIG. 2 is a schematic structural diagram of a hydraulic jet nozzle set.
Figure 3:
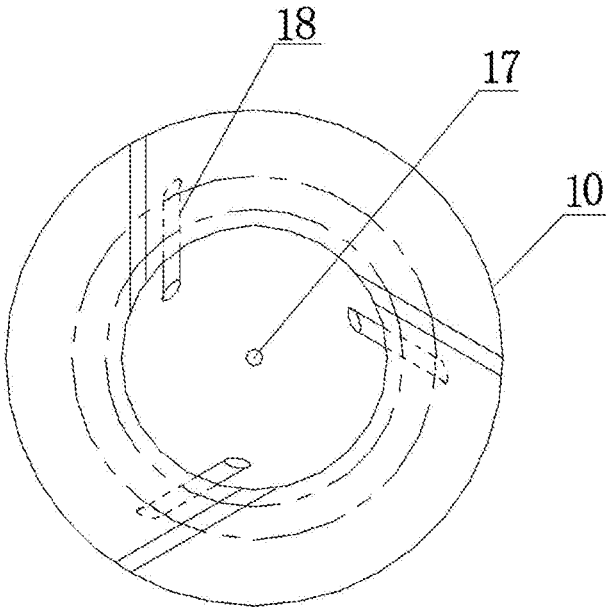
FIG. 3 is a right-side view of FIG. 2.
Figure 4:
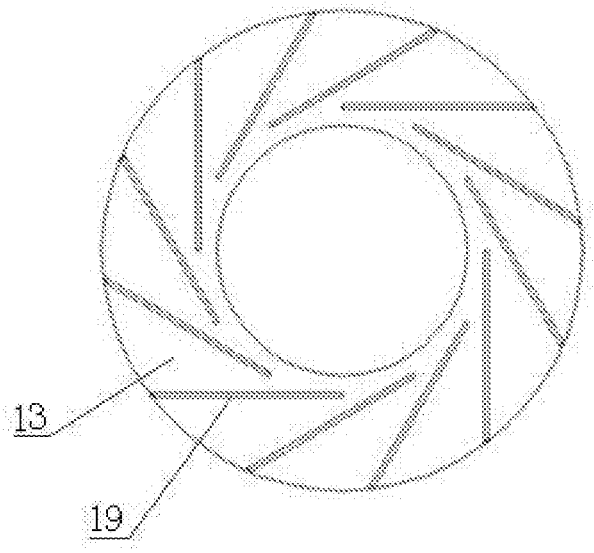
FIG. 4 is a distribution diagram of the flow channels on a sleeve II.

As shown in FIG. 1 and FIG. 2, a method for solid-state fluidization mining of seabed shallow layer non-diagenetic natural gas hydrates by using the device described above comprises the following steps:

S1, lowering of the riser: drilling from the seabed surface layer 20 to the hydrate ore bed 21 using a jet drilling method, and lowering the riser 5 into a drilled wellbore, wherein the riser 5 connects the seabed surface layer with the hydrate ore bed to form a drilling fluid circulating channel while isolating seawater, thereby realizing the lowering of the riser 5;

S2, lowering of the guide seat: controlling a drilling direction by using the guide seat 6, and adjusting a wellbore trajectory to a horizontal mode;

S3, lowering and mounting of the hydraulic jet nozzle set 1: lowering the hydraulic jet nozzle set 1 to a horizontal channel of the L-shaped channel 24 of the guide seat 6 first, such that the hydraulic jet nozzle set 1 is positioned in the hydrate ore bed 21; connecting the flow passage 11 of the nozzle body 7 and the hydrate collecting ship 3 by using the coiled tubing 2, and then sleeving the nozzle body 7 with one end of the delivery pipe 22; and finally connecting a straight channel of the guide seat 6 and the transfer station 4 by using the pipeline 25, thereby realizing the lowering and mounting of the hydraulic jet nozzle set 1;

S4, crushing of hydrates: introducing high-pressure seawater to the coiled tubing 2 by using the hydrate collecting ship 3, wherein a part of high-pressure seawater sequentially flows through the flow passage 11, the sleeve I 8, the sleeve II 9 and the cavity 16 and is finally jetted from the axial jet hole 17 and the oblique jet holes B 18, and hydrates in the horizontal direction are crushed by high-pressure jet water jetted from the axial jet hole 17 to form solid particle hydrates while an advancing channel is opened up; however, the high-pressure seawater jetted from the oblique jet holes B 18 has an opposite acting force, thereby forming a torque and further driving the spray head 10 and the sleeve II 9 to rotate circumferentially; the high-pressure jet water sweeps over a circle or a spiral line to crush the hydrates in the circumferential direction to form solid particle hydrates, thereby forming a cylindrical crushed ore cavity in the hydrate ore bed 21; the other part of high-pressure seawater is jetted from the oblique jet holes A 12 to provide an advancing power for the whole hydraulic jet nozzle set 1 and the coiled tubing 2, such that energy sources are saved, pollutions to sea are avoided, and the mining cost of natural gas is also reduced; meanwhile, water current jetted backwards will contribute to a backward movement of the front crushed solid particle hydrates along with the water current, which is beneficial to the collection of particles; and S5, collection of the crushed solid particle hydrates: driving, by water current jetted from the oblique jet holes A 12, the solid particle hydrates to move backwards, wherein the solid particle hydrates enter the delivery pipe 22 from an opening in the left side of the delivery pipe 22, move along the delivery pipe 22, flow out from an opening in the right side of the delivery pipe 22, pass through the straight channel and the pipeline 25 in sequence and finally enter into the transfer station 4, and are ultimately delivered to the hydrate collecting ship 3 from the transfer station 4 and are collected, thereby realizing massive and high-efficiently collection of the crushed solid particle hydrates; by rotating the guide seat 6, the hydraulic jet nozzle set 1 can be adjusted to do a circumferential direction within a plane, such that a large-scale cavity is formed inside the hydrate ore bed 21, and therefore, the hydrates can be mined in a large scale, and the mining quantity of the solid particle hydrates is increased.

Moreover, in the case of not changing the temperature and pressure of the seabed hydrate ore bed, natural gas hydrates are directly crushed into solid particles, such that the decomposition of hydrates and the resulting environmental and geological disasters are avoided. The mixture of the natural gas hydrate particles and sea water is then pumped to the sea surface through an airtight pipeline, and then separated, decomposed and gasified.

The foregoing description is only preferred embodiments of the present invention, and it should be understood that the present invention is not limited to the forms disclosed herein, and should not be taken as excluding other embodiments, but may be used in various other combinations, modifications, and environments, and can be amended within the concept described herein in accordance with the teachings above or techniques or knowledge in the related art. Modifications and changes made by those skilled in the art without departing from the spirit and scope of the present invention shall fall within the protection scope of the appended claims of the present invention.

We claim:

1. A device for solid-state fluidization mining of seabed shallow layer non-diagenetic natural gas hydrates, comprising a hydraulic jet nozzle set, a coiled tubing, a hydrate collecting ship arranged on a sea surface, a transfer station arranged in sea water and a riser arranged in a seabed surface layer, wherein a guide seat is arranged in the riser; the hydraulic jet nozzle set is arranged in the guide seat; the hydraulic jet nozzle set comprises a nozzle body, a first sleeve, a second sleeve and a spray head, wherein a right end of the nozzle body is connected with a left end of the first sleeve; the nozzle body is internally provided with a flow passage which is communicated with the first sleeve; a cylindrical surface of the nozzle body is uniformly distributed with a plurality of first oblique jet holes communicated with the flow passage in a circumferential direction of the cylindrical surface of the nozzle body; the first oblique jet holes tilt to left and are arranged eccentrically from the nozzle body; the second sleeve consists of a big shaft and a small shaft which are connected in sequence; the big shaft is arranged in the first sleeve and has a gap therebetween; an asbestos filter net is propped between the big shaft and the nozzle body; the small shaft penetrates through the first sleeve along an axis of the first sleeve and is connected with the spray head; a left end of the spray head is provided with a cavity which is communicated with the second sleeve, and a right end of the spray head is provided with an axial jet hole communicated with the cavity; a cylindrical surface of the spray head is uniformly distributed with a plurality of second oblique jet holes communicated with the cavity in a circumferential direction of the cylindrical surface of the spray head; the second oblique jet holes tile to right and are arranged eccentrically from the spray head; the guide seat is internally provided with a straight channel and an L-shaped channel from top to bottom; the straight channel is connected with the transfer station via a pipeline; a delivery pipe is arranged in the L-shaped channel; a first end of the coiled tubing is connected to the hydrate collecting ship, and a second end of the coiled tubing penetrates through the pipeline from top to bottom and is communicated with the flow passage of the nozzle body; a first end of the delivery pipe sleeves the coiled tubing, and a second end of the delivery pipe sleeves the nozzle body; an opening is formed in each of two ends of the delivery pipe; the transfer station is connected with the hydrate connecting ship.

2. The device for solid-state fluidization mining of seabed shallow layer non-diagenetic natural gas hydrates according to claim 1, wherein the right end of the nozzle body is provided with first external threads, a left end surface of the first sleeve is provided with a first threaded hole, and the first threaded hole of the first sleeve is connected with the first external threads of the nozzle body.

3. The device for solid-state fluidization mining of seabed shallow layer non-diagenetic natural gas hydrates according to claim 1, wherein a right end of the small shaft is provided with second external threads, and the cavity is internally provided with a second threaded hole.

4. The device for solid-state fluidization mining of seabed shallow layer non-diagenetic natural gas hydrates according to claim 1, wherein the spray head is fixedly connected to the second sleeve via a third threaded hole and second external threads of the small shaft.

5. The device for solid-state fluidization mining of seabed shallow layer non-diagenetic natural gas hydrates according to claim 1, wherein a left end surface and a right end surface of the big shaft are respectively provided with a flow channel.

6. The device for solid-state fluidization mining of seabed shallow layer non-diagenetic natural gas hydrates according to claim 5, wherein the flow channels are uniformly distributed in a circumferential direction of the big shaft.

7. The device for solid-state fluidization mining of seabed shallow layer non-diagenetic natural gas hydrates according to claim 1, wherein the transfer station is a deliver pump.

8. A method for solid-state fluidization mining of seabed shallow layer non-diagenetic natural gas hydrates by using the device according to claim 1, comprising the following steps:

S1, lowering of the riser: drilling from the seabed surface layer to a hydrate ore bed using a jet drilling method, and lowering the riser into a drilled wellbore, wherein the riser connects the seabed surface layer with the hydrate ore bed to form a drilling fluid circulating channel while isolating seawater, thereby realizing the lowering of the riser;

S2, lowering of the guide seat: controlling a drilling direction by using the guide seat, and adjusting a wellbore trajectory to a horizontal mode;

S3, lowering and mounting of the hydraulic jet nozzle set: lowering the hydraulic jet nozzle set to a horizontal channel of the L-shaped channel of the guide seat first, such that the hydraulic jet nozzle set is positioned in the hydrate ore bed; connecting the flow passage of the nozzle body and the hydrate collecting ship by using the coiled tubing, and then sleeving the nozzle body with one end of the delivery pipe; and finally connecting a straight channel of the guide seat and the transfer station by using the pipeline, thereby realizing the lowering and mounting of the hydraulic jet nozzle set;

S4, crushing of hydrates: introducing high-pressure seawater to the coiled tubing by using the hydrate collecting ship, wherein a part of high-pressure seawater sequentially flows through the flow passage, the first sleeve, the second sleeve and the cavity and is finally jetted from the axial jet hole and the second oblique jet holes B, hydrates in the horizontal direction are crushed by high-pressure jet water jetted from the axial jet hole to form solid particle hydrates while an advancing channel is opened up; however, the high-pressure seawater jetted from the second oblique jet holes has an opposite acting force, thereby forming a torque and further driving the spray head and the second sleeve to rotate circumferentially; the high-pressure jet water sweeps over a circle or a spiral line to crush the hydrates in the circumferential direction to form solid particle hydrates, thereby forming a cylindrical crushed ore cavity in the hydrate ore bed; the other part of high-pressure seawater is jetted from the first oblique jet holes to provide an advancing power for the whole hydraulic jet nozzle set and the coiled tubing; and S5, collection of the crushed solid particle hydrates: driving, by water jetted from the first oblique jet holes, the solid particle hydrates to move backwards, wherein the solid particle hydrates enter the delivery pipe from an opening in a left side of the delivery pipe, move along the delivery pipe, flow out from an opening in a right side of the delivery pipe, pass through the straight channel and the pipeline in sequence and finally enter into the transfer station, and are ultimately delivered to the hydrate collecting ship from the transfer station and are collected, thereby realizing massive and high-efficiently collection of the crushed solid particle hydrates.

9. The method for solid-state fluidization mining of seabed shallow layer non-diagenetic natural gas hydrates according to claim 8, wherein the right end of the nozzle body is provided with first external threads, a left end surface of the first sleeve-is provided with a first threaded hole, and the first threaded hole of the first sleeve is connected with the first external threads of the nozzle body.

10. The method for solid-state fluidization mining of seabed shallow layer non-diagenetic natural gas hydrates according to claim 8, wherein a right end of the small shaft is provided with second external threads, and the cavity is internally provided with a second threaded hole.

11. The method for solid-state fluidization mining of seabed shallow layer non-diagenetic natural gas hydrates according to claim 8, wherein the spray head is fixedly connected to the second sleeve via a third threaded hole and second external threads of the small shaft.

12. The method for solid-state fluidization mining of seabed shallow layer non-diagenetic natural gas hydrates according to claim 8, wherein a left end surface and a right end surface of the big shaft are respectively provided with a flow channel.

13. The method for solid-state fluidization mining of seabed shallow layer non-diagenetic natural gas hydrates according to claim 12, wherein the flow channels-are uniformly distributed in a circumferential direction of the big shaft.

14. The method for solid-state fluidization mining of seabed shallow layer non-diagenetic natural gas hydrates according to claim 8, wherein the transfer station is a deliver pump.

* * * * *